US006158521A

United States Patent [19]

Klump

[11] Patent Number: 6,158,521

[45] Date of Patent: Dec. 12, 2000

[54] PORTABLE FIRE-FIGHTING CONTAINER WITH FOLDING FUNNEL

[76] Inventor: James A. Klump, P.O. Box 5, Forbestown, Calif. 95941

[21] Appl. No.: 09/306,982

[22] Filed: May 7, 1999

[51] Int. Cl.[7] ..... A62C 11/00; A62C 25/00; A62C 35/00

[52] U.S. Cl. ..... 169/30; 169/13; 169/53

[58] Field of Search ..... 169/13, 14, 30, 169/51, 52, 53, 91

[56] References Cited

U.S. PATENT DOCUMENTS

| | | | |
|---|---|---|---|
| 3,428,276 | 2/1969 | Hubbard | 169/53 X |
| 3,661,211 | 5/1972 | Powers | 169/53 |
| 4,593,855 | 6/1986 | Forsyth . | |
| 4,729,434 | 3/1988 | Rohrbach . | |
| 5,699,862 | 12/1997 | Rey | 169/53 |
| 5,881,817 | 3/1999 | Mahrt | 169/14 X |
| 5,890,612 | 4/1999 | Coppi | 220/7 |

*Primary Examiner*—Andres Kashnikow
*Assistant Examiner*—Jorge S. Bocanegra
*Attorney, Agent, or Firm*—Jack Lo

[57] ABSTRACT

A portable fire-fighting container is comprised of a box with a top opening and compartments on its sides. A liquid receptacle is positioned inside the box under the top opening thereof. An interior liner is positioned inside the liquid receptacle. An open top of the liquid receptacle is covered with a removable lid. Sling attachments arranged around the box enable the container to be airlifted by a helicopter. The lid is removed and positioned vertically on top of the box to provide directional stability in flight. When placed at a fire location, leveling jacks around the box provide stability on uneven ground. Trapezoidal frames are hinged along the edges of the top opening of the box. The frames are pivoted upward and supported at an acute angle by braces extending between the frames and the top of the box, thus forming an inverted truncated pyramid. An extendible top portion of the interior liner in the liquid receptacle is pulled out from the top opening of the box and wrapped around the top edges of the frames, thus forming a funnel for receiving liquid dropped from aircraft. Pumping equipment and hoses received in the compartments in the box deliver the liquid for fighting fire.

17 Claims, 2 Drawing Sheets

PORTABLE FIRE-FIGHTING CONTAINER WITH FOLDING FUNNEL

BACKGROUND OF THE INVENTION

1. Field of the Invention

This invention relates generally to portable fire-fighting devices for fighting fires in remote locations.

2. Prior Art

In the fight against wild fires, firefighters are supplied with portable water tanks transported by truck or helicopter. The equipment for pumping water from the tanks, such as engine-driven pumps, hoses, etc., are usually ordered as necessary and transported separately from the tanks. Due to logistical difficulties in the transmission and filling of such orders, the tanks and associated equipment often arrive at widely different times, so that the fire fighting effort is significantly delayed. Even when the all the pieces are gathered, they are time consuming to assemble and connect together.

Some water tanks with built-in pumping equipment are disclosed in the prior art. U.S. Pat. No. 4,729,434 to Rohrbach discloses a portable fire-fighting device comprised of a fully enclosed water tank, chemical agent tanks, and a hose reel. The water and chemical agents are powered through the hoses by compressed gas bottles. However, the closed water tank and compressed gas bottles are relatively small and cannot be easily refilled on site, so that the device has a very limited operating time. It is simply mounted on a pair of skids, which cannot sit stably on uneven ground. U.S. Pat. No. 4,593,855 to Forsyth discloses a truck-mounted fire-fighting device comprised of an engine-powered pump that pumps liquid from a fully enclosed tank. Again, the enclosed tank is small and cannot be easily refilled on site, so that the device has a relatively short operating time. It is designed only for being transported by truck, so that it cannot be delivered to locations inaccessible by wheeled vehicles.

OBJECTS OF THE INVENTION

Accordingly, objects of the present fire-fighting container are:

- to be transportable by wheeled vehicle or helicopter to a fire at any location;
- to be easily refillable by helicopter for prolonged operation;
- to be stable in flight when carried by a helicopter;
- to be stable when placed on uneven ground;
- to be fully self-contained with all the necessary equipment;
- to be collapsible for compactness; and
- to provide additional liquid capacity when erected.

Further objects of the present invention will become apparent from a consideration of the drawings and ensuing description.

BRIEF SUMMARY OF THE INVENTION

A portable fire-fighting container is comprised of a box with a top opening and compartments on its sides. A liquid receptacle is positioned inside the box under the top opening thereof. An interior liner is positioned inside the liquid receptacle. An open top of the liquid receptacle is covered with a removable lid. Sling attachments arranged around the box enable the container to be airlifted by a helicopter. The lid is removed and positioned vertically on top of the box to provide directional stability in flight. When placed at a fire location, leveling jacks around the box provide stability on uneven ground. Trapezoidal frames are hinged along the edges of the top opening of the box. The frames are pivoted upward and supported at an acute angle by braces extending between the frames and the top of the box, thus forming an inverted truncated pyramid. An extendible top portion of the interior liner in the liquid receptacle is pulled out from the top opening of the box and wrapped around the top edges of the frames, thus forming a funnel for receiving liquid dropped from aircraft. Pumping equipment and hoses received in the compartments in the box deliver the liquid for fighting fire.

DRAWING REFERENCE NUMERALS

| | |
|---|---|
| 10. Box | 11. Top Opening |
| 12. Compartment | 13. Compartment |
| 14. Liquid Receptacle | 15. Plate |
| 16. Sling Attachments | 17. Frame |
| 18. Frame | 19. Frame |
| 20. Frame | 21. Brackets |
| 22. Pumping Equipment | 23. Pump |
| 24. Engine | 25. Valve |
| 26. Foam Tank | 27. Foam Proportioner |
| 28. Leveling Jacks | 29. Braces |
| 30. Liner | 31. Top Portion |

DETAILED DESCRIPTION OF THE INVENTION

Figure 1:
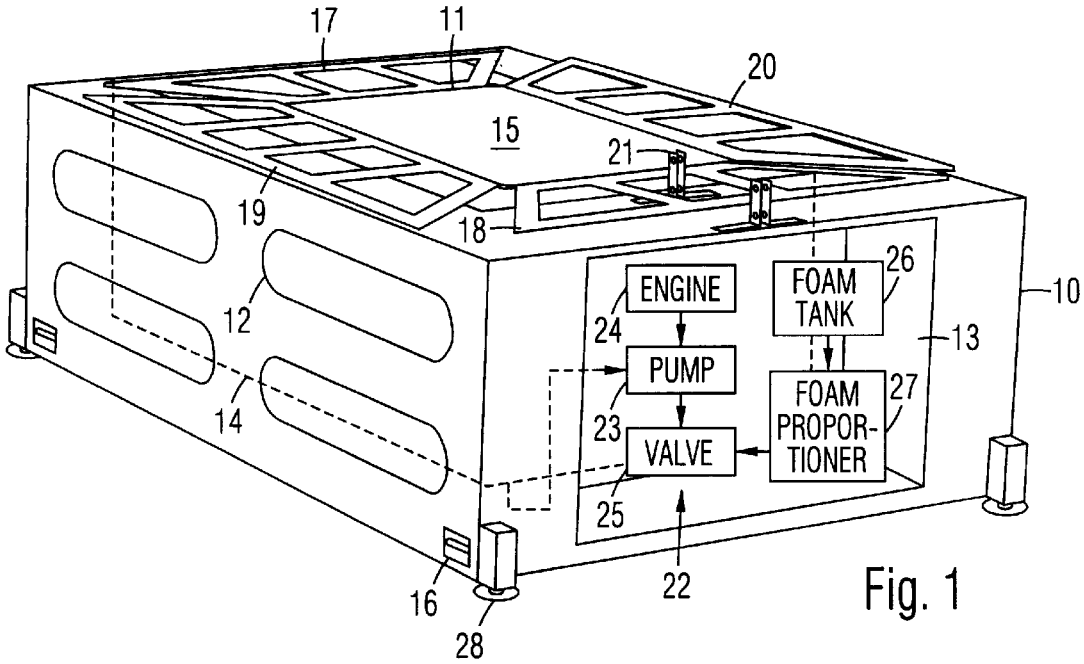
FIG. 1 is a front perspective view of the present portable fire-fighting container in a fully compacted condition.

FIG. 1:

A preferred embodiment of a portable fire-fighting container is shown in a front perspective view in FIG. 1. It is comprised of a box 10 with a preferably rectangular top opening 11 and compartments 12 and 13 on its sides. A liquid receptacle 14 with an open top is positioned inside box 10 under top opening 11, which is covered with a removable lid or cover plate 15. Sling attachments 16 arranged generally at the corners of box 10 enable the container to be attached to a sling for being airlifted by a helicopter. Frames 17–20, which are preferably trapezoidal, are hinged along the edges of top opening 11. A pair of brackets 21 are aligned longitudinally on top of box 10. Pumping equipment 22 is positioned inside compartment 13, and is comprised of a pump 23 connected to liquid receptacle 14 and driven by an engine 24. Pump 23 is connected to a valve 25. A fire-retardant foam tank 26 is connected to a foam proportioner 27, which is also connected to valve 25. Various other equipment are received in compartments 12, such as hoses. Leveling jacks 28 are attached generally at the corners of box 10.

FIG. 2:

The portable fire-fighting container may be transported by various vehicles, including wheeled vehicles and aircraft.

Figure 2:
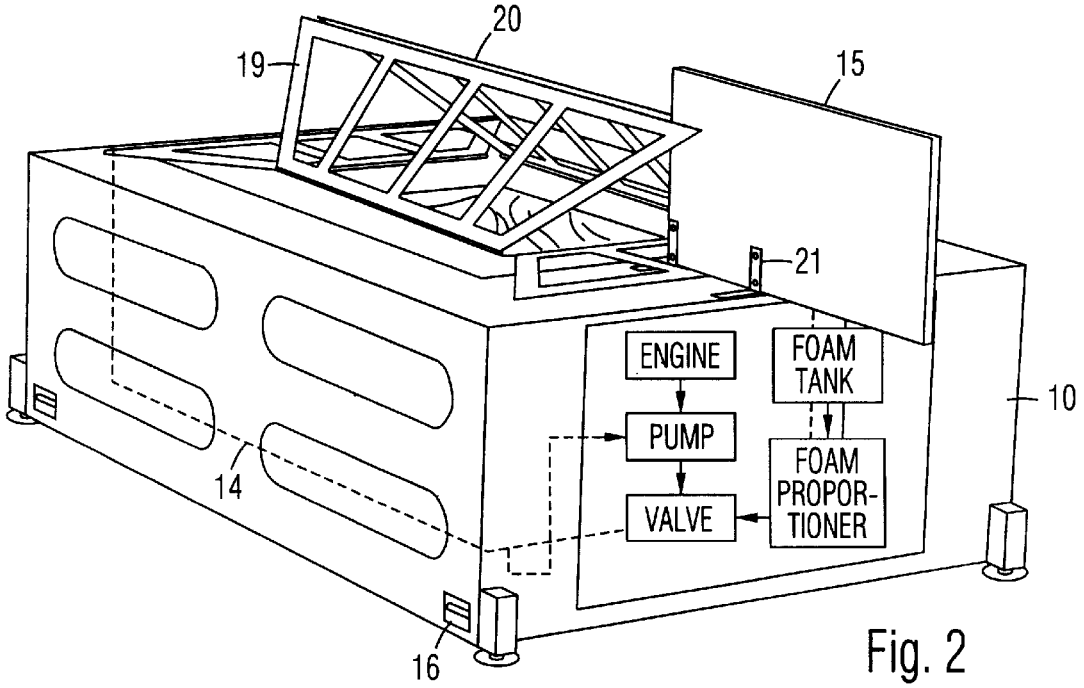
FIG. 2 is a front perspective view of the container arranged for flight under a helicopter.

For fighting fires in remote locations inaccessible to wheeled vehicles, it may be airlifted by helicopter. When being airlifted, cover plate 15 is removed from the top opening of box 10 and attached vertically to brackets 21 to provide directional stability in flight, as shown in FIG. 2. Frames 19 and 20 are pivoted upwardly into engagement with opposite sides of cover plate 15 to provide lateral support.

Figure 3:
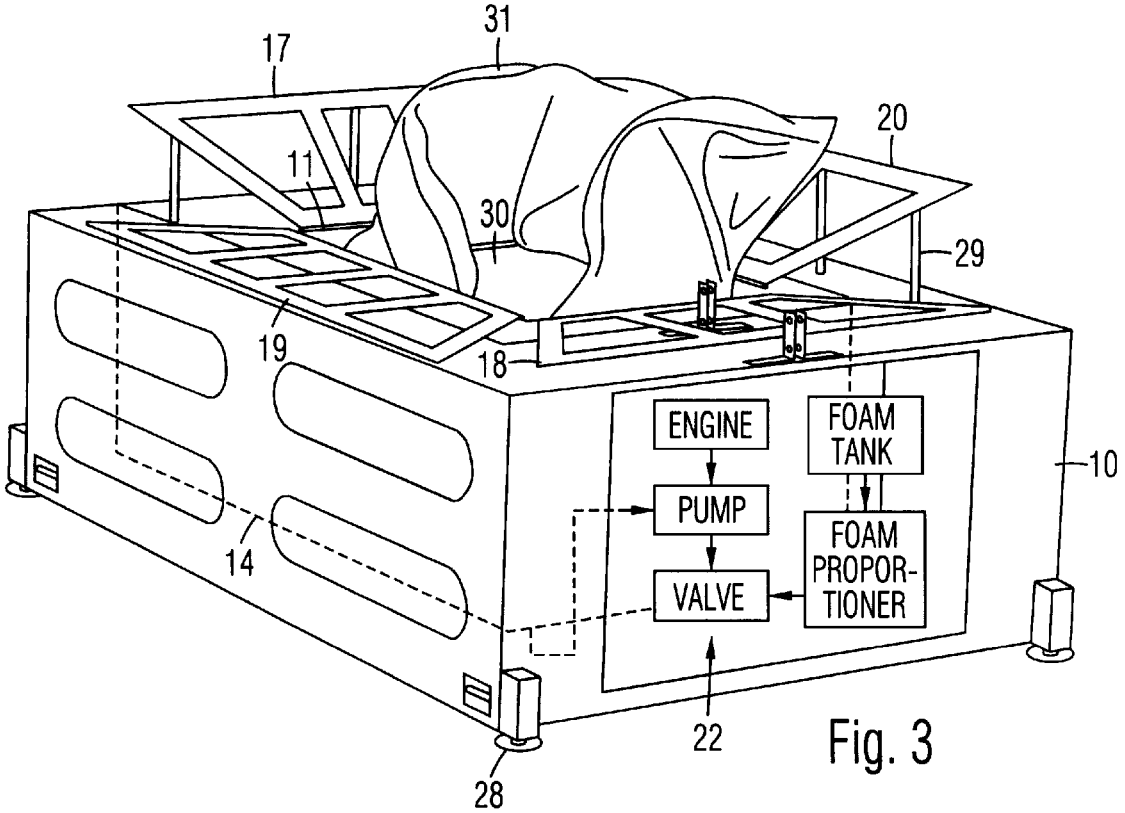
FIG. 3 is a front perspective view of the container when a collapsible funnel thereof is being erected.
Figure 4:
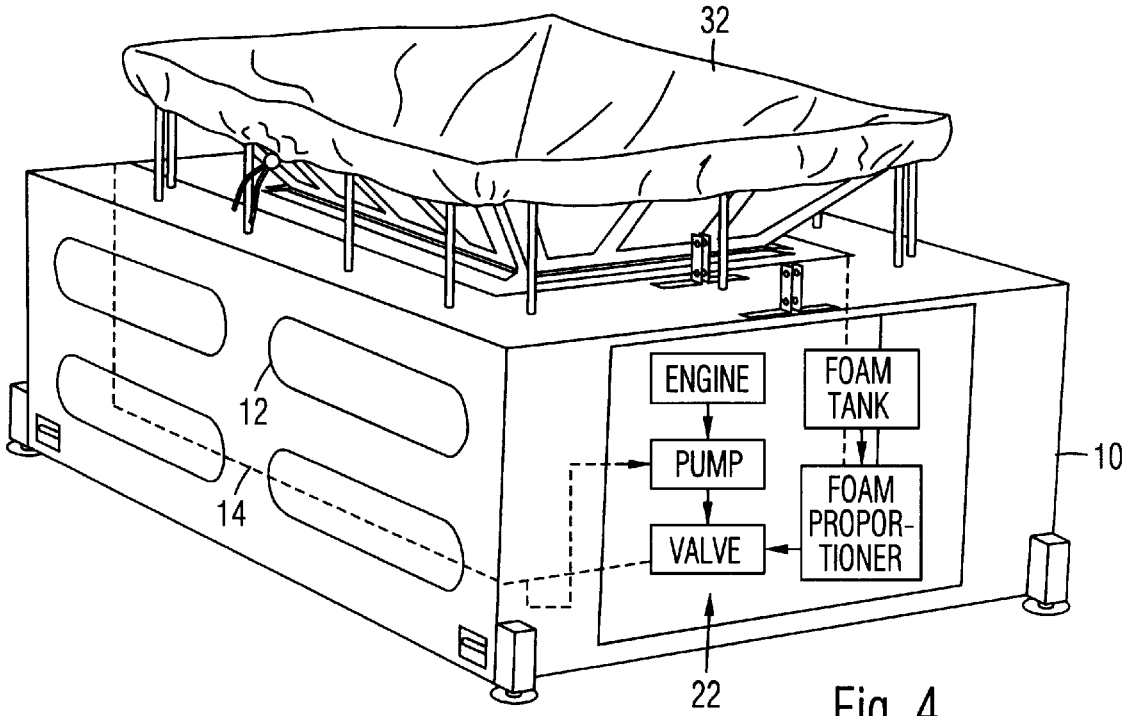
FIG. 4 is a front perspective view of the container when the funnel is positioned for operation.

FIGS. 3–4:

When placed near a fire, leveling jacks 28 around box 10 are adjusted to provide stability on uneven ground. Cover plate 15 (FIG. 2) is removed. As shown in FIG. 3, trapezoidal frames 17–20 are pivoted upwardly and supported at an acute angle relative to the top of box 10 by braces 29 attached between frames 17–20 and the top of box 10. An inverted truncated pyramid is thus defined by frames 17–20. A watertight interior liner 30 is positioned inside receptacle 14. An extendible top portion 31 of interior liner 30 is pulled through top opening 11 of box 10 and wrapped around the top edges of frames 17–20, thus forming a collapsible funnel 32 for receiving air-dropped water, as shown in FIG. 4. In addition to the capacity in receptacle 14, additional capacity for liquid is also provided by funnel 32. The liquid in receptacle 14 is mixed with foam by pumping equipment 22 and delivered to a fire through the hoses removed from compartments 12. Receptacle 14 may be refilled easily over and over again with a bucket suspended under a helicopter for prolonged operation.

SUMMARY AND SCOPE

Accordingly, a portable fire-fighting container is provided. It is portable by wheeled vehicle or helicopter for being transported to a fire at any location. It is easily refillable by helicopter for prolonged operation. It is stable in flight when carried by a helicopter. It is stable when placed on uneven ground. It is fully self-contained with all the necessary equipment. It is collapsible for compactness. It also provides additional liquid capacity when erected.

Although the above description is specific, it should not be considered as a limitation on the scope of the invention, but only as an example of the preferred embodiment. Many variations are possible within the teachings of the invention. For example, wheels may be added for towing behind a vehicle. Frames 17–20 may be solid plates. Therefore, the scope of the invention should be determined by the appended claims and their legal equivalents, not by the examples given.

I claim:

1. A portable fire-fighting container, comprising:

a rigid box with a top opening;

a liquid receptacle positioned inside said box under said top opening;

a collapsible funnel attached to said top opening of said rigid box, said collapsible funnel being movable between a folded position and an extended position extending upwardly from said box, wherein said funnel is adapted for directing liquid dropped from above into said liquid receptacle and for providing additional capacity for said liquid; and pumping equipment arranged in a protected position within a compartment inside said rigid box and connected to said liquid receptacle, said pumping equipment enabling said portable fire-fighting container to be immediately usable when placed near a fire and filled with said liquid.

2. The portable fire-fighting container of claim 1, wherein said collapsible funnel is comprised of a plurality of trapezoidal frames hinged along a plurality of edges of said top opening, said frames being movable to said open position angled upwardly forming an inverted truncated pyramid.

3. The portable fire-fighting container of claim 1, further including a plurality of collapsible supporting braces when said collapsible funnel is in said extended position, said braces extending between said collapsible funnel and said box for additional strength.

4. The portable fire-fighting container of claim 1, further including a plurality of sling attachments arranged around said box for attaching to a sling for airlifting.

5. The portable fire-fighting container of claim 1, further including a plate removably attached to an exterior of said box extending away from said box for providing directional stability when being airlifted.

6. The portable fire-fighting container of claim 1, wherein said pumping equipment comprises a pump connected to said liquid receptacle, an engine driving said pump, a foam tank connected to a foam proportioner, and a valve connected to said pump and said foam proportioner for mixing said liquid with foam stored in said foam tank.

7. A portable fire-fighting container, comprising:

a rigid box with a top opening;

a liquid receptacle positioned inside said box under said top opening;

a plurality of trapezoidal frames hinged along a plurality of edges of said top opening, said frames being movable between a folded position disconnected from each other for compactness, and an extended position connected together and angled upwardly from said box forming a funnel; and a watertight liner with an inner end positioned inside said liquid receptacle and a loose outer end, wherein when said frames are disconnected from each other and collapsed, said loose outer end of said liner is disconnected from said frames and storable inside said liquid receptacle to avoid damage, and when said frames are extended and connected together to form said funnel, said loose outer end of said liner is wrapped around top edges of said funnel for directing liquid dropped from above into said liquid receptacle and for providing additional capacity for said liquid.

8. The portable fire-fighting container of claim 7, further including a plurality of collapsible supporting braces extending between said frames and said box for additional strength.

9. The portable fire-fighting container of claim 7, further including a plurality of sling attachments arranged around said box for attaching to a sling for airlifting.

10. The portable fire-fighting container of claim 7, further including a plurality of leveling jacks arranged around said box for positioning on uneven ground.

11. The portable fire-fighting container of claim 7, further including a plate removably attached to an exterior of said box extending away from said box for providing directional stability when being airlifted.

12. The portable fire-fighting container of claim 7, further including built-in pumping equipment attached to said box for pumping said liquid, so that said portable fire-fighting container is immediately usable when placed near a fire and filled with said liquid.

13. The portable fire-fighting container of claim 7, further including built-in pumping equipment attached to said box for pumping said liquid, so that said portable fire-fighting container is immediately usable when placed near a fire and filled with said liquid, said pumping equipment comprising a pump connected to said liquid receptacle, an engine driving said pump, a foam tank connected to a foam proportioner, and a valve connected to said pump and said foam proportioner for mixing said liquid with foam stored in said foam tank.

14. A portable fire-fighting container, comprising:

a rigid box with a top opening;

a liquid receptacle positioned inside said box under said top opening;

pumping equipment arranged in a protected position within a compartment inside said rigid box and connected to said liquid receptacle;

a collapsible funnel attached to said top opening of said rigid box, said collapsible funnel being movable between a folded position, and an extended position extending upwardly from said box, wherein said funnel is adapted for directing liquid dropped from above into said liquid receptacle and for providing additional capacity for said liquid; and a plurality of leveling jacks arranged around said box for positioning on uneven ground.

15. The portable fire-fighting container of claim 14, wherein said collapsible funnel is comprised of a plurality of trapezoidal frames hinged along a plurality of edges of said top opening, said frames being movable to said open position angled upwardly forming an inverted truncated pyramid.

16. The portable fire-fighting container of claim 14, wherein said pumping equipment is comprised of a pump connected to said liquid receptacle, an engine driving said pump, a foam tank connected to a foam proportioner, and a valve connected to said pump and said foam proportioner for mixing said liquid with foam stored in said foam tank.

17. The portable fire-fighting container of claim 14, further including a plate removably attached to an exterior of said box extending away from said box for providing directional stability when being airlifted.

* * * * *